United States Patent [19]

Wernli

[11] 4,231,415

[45] Nov. 4, 1980

[54] APPARATUS FOR THE PRODUCTION OF FOUNDRY SAND MOLDS

[75] Inventor: Max Wernli, Schaffhausen, Switzerland

[73] Assignee: Georg Fischer Aktiengesellschaft, Schaffhausen, Switzerland

[21] Appl. No.: 971,787

[22] Filed: Dec. 21, 1978

Related U.S. Application Data

[62] Division of Ser. No. 809,040, Jun. 22, 1977, Pat. No. 4,144,925.

[30] Foreign Application Priority Data

Jun. 25, 1976 [CH] Switzerland ..... 8151/76
May 18, 1977 [CH] Switzerland ..... 6181/77

[51] Int. Cl.[3] ..... B22C 15/22; B22C 15/26; B22C 17/08

[52] U.S. Cl. ..... 164/160; 164/183; 164/192; 164/200; 164/202

[58] Field of Search ..... 164/160, 200, 202, 192, 164/183

[56] References Cited

U.S. PATENT DOCUMENTS

| | | | |
|---|---|---|---|
| 1,594,598 | 8/1926 | Campbell | 164/202 |
| 3,659,642 | 5/1972 | Vasilovsky et al. | 164/202 X |
| 3,807,483 | 4/1974 | Buhler | 164/202 X |

FOREIGN PATENT DOCUMENTS

| | | | |
|---|---|---|---|
| 44-19522 | 8/1969 | Japan | 164/193 |

*Primary Examiner*—Robert D. Baldwin
*Assistant Examiner*—J. Reed Batten, Jr.
*Attorney, Agent, or Firm*—Toren, McGeady and Stanger

[57] ABSTRACT

A dosed amount of molding sand is placed in a vessel arranged at a given distance from a pattern device from which a mold is to be formed, and a pressurized force is applied against the molding sand in the vessel from the side thereof remote from the pattern device in order thereby to impart to the molding sand an acceleration in the direction of the pattern device to compress the sand about the pattern device with the velocity of the accelerated molding sand being braked by impact with the pattern device and also by impact partially with a molding box within which the pattern device is contained. The vessel containing the molding sand is connected to a pressure source by a valve device which controls the application of pressure to the molding sand. Additionally a vacuum device is utilized to apply suction tending to compact the sand within the vessel to produce a more cohesive mass. After the vessel and the pattern device are moved into operative position, and the suction has been terminated, the valve may be opened to apply a pressurized force propelling the sand from the vessel against the pattern device.

17 Claims, 12 Drawing Figures

APPARATUS FOR THE PRODUCTION OF FOUNDRY SAND MOLDS

This is a division of application Ser. No. 809,040 filed June 22, 1977 and now U.S. Pat. No. 4,144,925 issued Mar. 20, 1979.

BACKGROUND OF THE INVENTION

The present invention relates generally to foundry apparatus and more specifically to mechanism for the production of foundry sand molds. The invention is more specifically directed toward a device which utilizes a pressurized medium for compression of the molding sand about the pattern device from which the mold is to be formed.

In the prior art, and more specifically in a process known from German DAS No. 1,961,234, a certain amount of compressed air issuing from a compressed air tank arranged above a molding box acts briefly upon a batch of mold forming sand poured loosely over a pattern plate in a molding box to compress the sand, with the air passing through outflow openings in the pattern plate.

Processes of this type involve the disadvantage that the portion of the molding sand which is admitted directly by the compressed air is compressed more forcefully than the portion bearing upon the pattern arrangement.

Accordingly, the invention is directed toward providing apparatus whereby molding sand may be optimally compressed in the formation of a foundry sand mold. The optimum compression of the molding sand may be achieved independently of the individual pattern parts and maximum compression of the molding sand batch can be effected on all surfaces which will be brought into contact with a casting melt, as well as the mold parting surface, with the compression decreasing from the mold parting plane to the exterior of the mold.

SUMMARY OF THE INVENTION

Briefly, the present invention may be described as apparatus for producing foundry molds wherein a dosed quantity of mold forming material is introduced into a vessel with the vessel being arranged with the mold forming material at a given relative distance to a pattern device from which the mold is to be formed. A force is exerted on a side of the mold forming material within the vessel remote from the pattern device by application of a pressure medium to exert against the molding material a force which will accelerate the molding material toward the pattern device and propel the material against the pattern device thereby effecting a desired compression thereof. The pattern device includes a molding box which is attached thereto and after the molding material has been set into accelerated motion it impinges both the pattern device and the molding box and is therefore braked both by the pattern device and also, partly by the molding box.

The invention also comprises apparatus which differs from known arrangements in that a pressure tank is connected to the vessel which is open on one side by means of an intermediate plate provided with valve means in the plate. The molding box may be movably mounted adjoining the open side of the vessel and may be located at the open side of the vessel together with the pattern device. The pressure means which is applied through the intermediate plate and through the valve means operates to propel the molding sand against the pattern device.

The invention may also include vacuum means for applying a suction effect tending to compact the molding material within the vessel prior to operative joinder of the vessel with the pattern mechanism and the molding box and prior to application of the pressure medium to propel the molding material against the pattern device.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
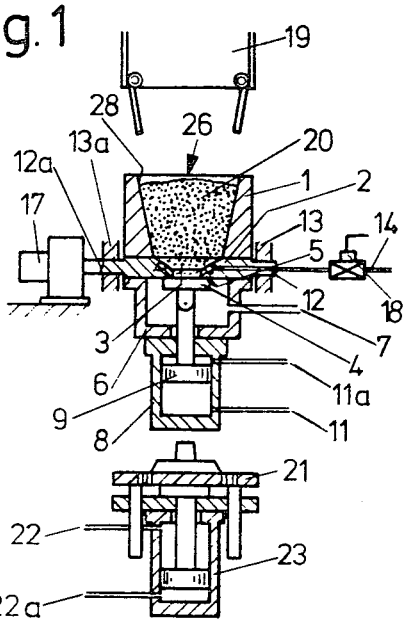
FIG. 1 is a sectional view of apparatus embodying the present invention showing an arrangement wherein molding sand has been dosed into a vessel.

Referring now to the drawings wherein like reference numerals are used to refer to similar parts throughout the various figures thereof a first embodiment of the invention is depicted in FIGS. 1–4 which show a sequence of operations for utilizing the apparatus of the present invention in a method for forming foundry molds. A vessel 1 for receiving and delivering a dosed amount of molding sand for the production of the casting mold has connected thereto an intermediate plate 2 which has an opening 3 provided on a side of the vessel 1 remote from its opened end, with the plate 2 being designed to form valve means which include a valve seat 5*a* adapted to be engaged by a valve member 4 for opening and closing the opening 3 whereby communication through the opening 3 with the interior of the vessel 1 may be controlled by valve means 5 consisting of the seat 5*a* and the valve member 4.

A pressure tank 6 for receiving a pressurized fluid medium through a conduit 7 is attached to the intermediate plate 2 and a thrust piston drive 8 which is pneumatically or hydraulically operated is arranged by a flanged connection on the pressure tank 6 with a thrust piston 9 being articulated by a joint 10 to the valve member 4, the thrust piston 9 being located within the thrust piston drive 8 and operated by means of pressure control within the drive 8. The thrust piston drive 8 is actuated from a control device (not shown) by control conduits 11, 11*a* which admit and exhaust pressure fluid from the thrust piston drive 8 in order to actuate movement of the piston 9.

Journal members 12, 12*a* mounted in bearings 13, 13*a* are arranged laterally of the intermediate plate 2 in order to enable the vessel 1, the intermediate plate 2, the pressure tank 6 and the thrust piston drive 8, operating as a unit, to be swiveled or rotated about the axis of the journals 12, 12*a*.

Located within one of the journals 12, 12*a* there is provided a suction pipe 14 forming part of a vacuum means, with the pipe 14 extending axially of the journals and terminating at the opening 3 located in the intermediate plate 2. The mouth of the suction pipe 14 is advantageously designed as a ring conduit 15 (see FIG. 4) which is provided with a porous cover 16. The other end of the suction pipe 14 is connected to a suction unit (not shown) which may be a fan, with a control valve 18 operating to actuate a control system for regulating the entire arrangement.

From the valve seat 5*a* to the ring conduit 15 there extend connecting bores for back flushing in order to clean the porous cover 16 of the ring conduit 15.

The other of the journals 12, 12*a* opposite that including the suction pipe 14 is connected to a servomotor 17 by means of which the vessel 1, plate 2, pressure tank 6 and thrust piston drive 8 all operating as a unit may be rotated about the axis of the journals 12, 12*a*.

Above the members 1, 2, 6, and 8 combined as a unit there is arranged a molding sand silo 19 from which a dosed amount of molding sand 20 may be fed to the vessel 1 as the first step of a mold forming operation, as depicted in FIG. 1.

On the opposite side of the molding sand silo 19 along the axis of symmetry of the arrangement, there is provided a pattern device 21 which is moved by a fluid drive 23 actuated through control conduits 22, 22*a*. In order to locate a molding box 24 into a position coinciding with the vessel 1 and with the pattern device 21, there is provided a feed mechanism 25 which operates to move the molding box 24.

In the operation of the apparatus in accordance with the present invention the vessel 1 is actuated in a first mold forming step depicted in FIG. 1 so that its open side 26 is arranged toward the opening of the molding sand silo 19 and in this position the vessel 1 is filled with a dosed amount of molding sand 20. Subsequently, the control valve 18 of the vacuum means is opened and a suction effect is created through the suction pipe 14 with the suction being maintained in ring conduit 15 with suction afterflow through molding sand 20 with the molding sand 20 being thereby brought into a cohesive form.

Figure 2:
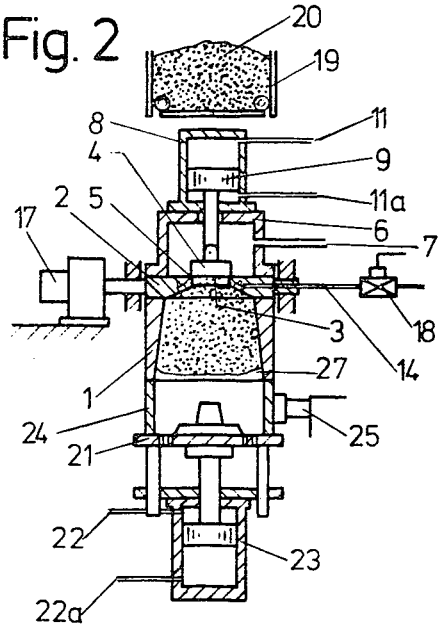
FIG. 2 is a view similar to the view of FIG. 1 showing the same arrangement during a subsequent step in the performance of the process of the invention wherein a molding box with a pattern plate is applied to the vessel containing the molding sand.
Figure 3:
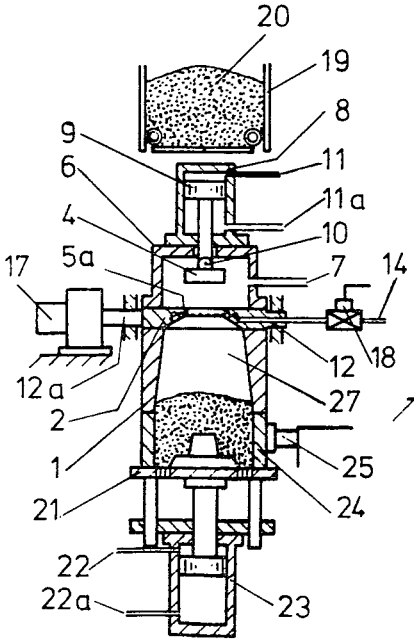
FIG. 3 is a view similar to the views of FIGS. 1 and 2 showing the same device during a subsequent stage in the operation thereof where molding sand is transferred to a molding box.
Figure 4:
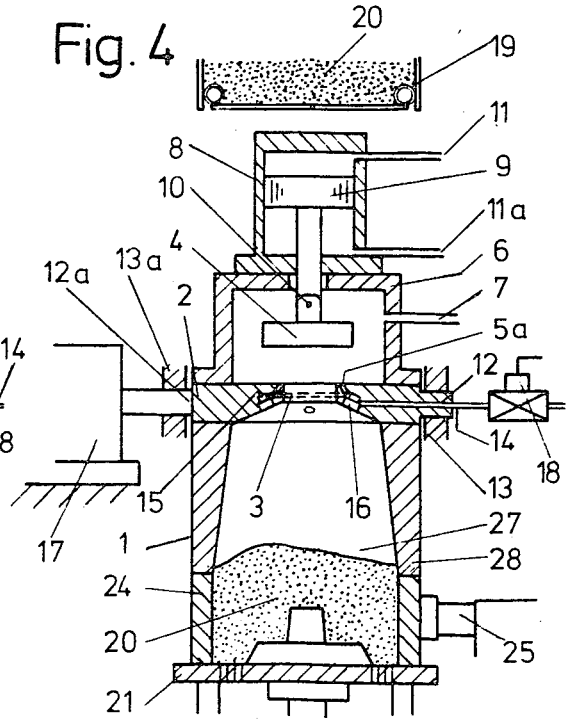
FIG. 4 is a view similar to FIG. 3 showing the arrangement depicted in FIG. 3 on an enlarged scale.
Figure 5:
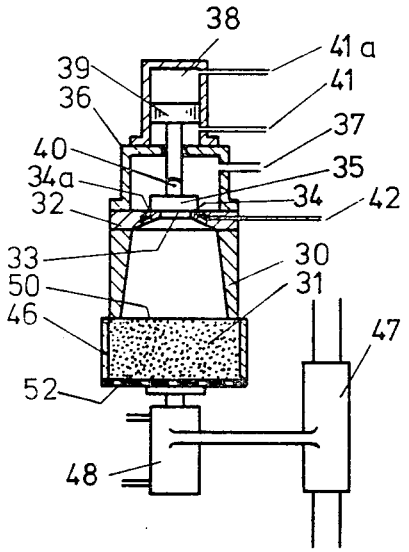
FIG. 5 is a sectional view taken through another embodiment of the invention including a molding sand silo.

With the molding sand 20 in this cohesive form, the vessel 1 including the parts which are connected thereto, is rotated by operation of the servomotor 17 in order to bring the open side 26 toward the direction of the pattern device 21. In this position of the vessel 1, a molding box 24 is brought into position to coincide with the vessel 1, as depicted in FIG. 2, and the pattern device 21 is located within the box 24 by actuation of a fluid drive 23. The molding box 24, the vessel 1 and the pattern device 21 are thus assembled and joined together in order to form a chamber 27.

Subsequently, the thrust piston drive 8 is actuated and the piston 9 is thus moved in order to lift the valve stem 4 from the valve seat 5*a*. As a result, a pressurized fluid contained within the pressure tank 6 and supplied thereto through the line 7 is emitted with excess pressure from the opening 3 thereby imparting to the batch of molding sand 20 an acceleration in the direction of the pattern device 21 which operates to suitably effect compression of the molding sand 20. The accelerated molding sand batch 20 is braked by the pattern device 21 when the sand batch strikes the pattern device and it is also partially braked by the molding box 24. Before, during and after the lifting of the valve stem 4 from the valve seat 5*a*, the control valve 18 is closed thereby alleviating the suction effect in the suction pipe 14.

After the molding sand 20 has been applied on the pattern device 21, the device 21 is moved from the box 24 by the actuating fluid drive 23 and the casting mold now formed in the box 24 is delivered by means of the feed mechanism 25 to a subsequent molding station. While the casting mold held in box 24 is being conveyed, excess molding sand will be stripped off the opening rim 28 of the vessel 1 to a level coincident with the level of the molding box. Of course, in order to perform this operation there may also be provided a sand stripper device which would produce similar results.

In the further performance of the method of the invention, the apparatus is actuated so that the vessel 1 and the parts attached therewith are turned as a unit by means of the servomotor 17 to be returned to their starting position depicted in FIG. 1 while at the same time the valve member 4 is brought into tight engagement with the valve seat 5*a* so that the starting position of the apparatus may once again be achieved in order to repeat a further sequence of mold forming operation.

Another embodiment of the invention is depicted in FIGS. 5–10 wherein a vessel 30 is provided for receiving and delivering the dosed amount of molding sand 31 which is to be utilized for the production of the casting mold. Connected with the vessel 30 is an intermediate plate 32 which is provided with an opening or orifice 33 having a valve member 35 bearing against the opening 33 whereby the opening 33 operates as a valve seat 34*a* forming valve means 34 together with the valve member 35.

Connected on one side thereof with the intermediate plate 32 is a pressure tank 36 with a pressurized fluid being supplied to the tank 36 through a conduit 37. The tank 36 has connected thereto a pneumatically or hydraulically operated thrust piston drive 38 including a thrust piston 39 which is connected to the valve member 35. Of course, it will be apparent that the thrust piston drive 38 may be replaced with an electrical or mechanical device performing a similar function.

The valve member 35 is preferably connected with the thrust piston 39 by an articulated joint 40. The thrust piston drive 38 is actuated by means of control conduits 41, 41*a* by a control system (not shown) which regulates the entire arrangement.

The vessel 30, the plate 32, the pressure tank 36 and the thrust piston drive 38 are arranged together to form a unit having a common axis of symmetry.

Substantially perpendicular to the axis of symmetry of this unit, there is provided a suction pipe 42 which extends through the plate 32 terminating within the orifice 33 extending through the intermediate plate 32.

The mouth of the suction pipe 42 is preferably designed as a ring conduit 43 provided with a porous cover 44. Suction pipe 42 is connected through a control valve 45 to a suction device (not shown) which may, for example, be a fan or blower.

From the valve seat 34*a* to the ring conduit 43 there are provided extending bores through which pressurized fluid is conducted from the pressure tank 36, with the valve 34 being opened to the rear side of the porous cover 44 for back flushing to clean the pores in the cover 44.

Figure 6:
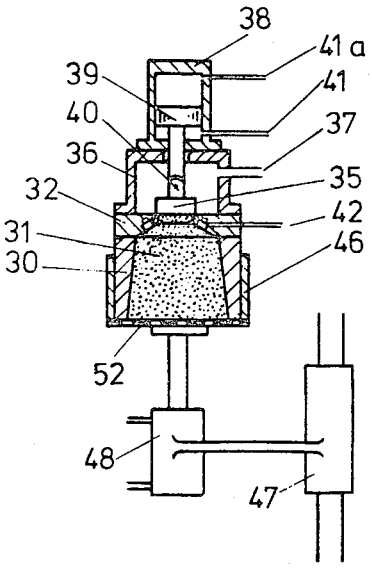
FIG. 6 is a view similar to that of FIG. 5 showing the same arrangement during a subsequent step in the operation of the apparatus where molding sand is placed in the vessel.
Figure 7:
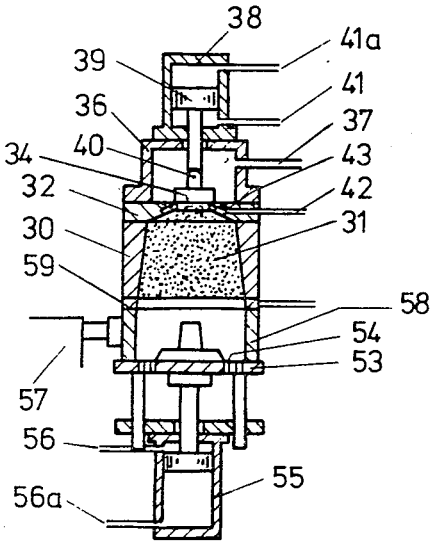
FIG. 7 is a view similar to the views of FIGS. 5 and 6 showing the same device during a subsequent step in the operation of the apparatus where a molding box and pattern plate are attached to the vessel.
Figure 8:
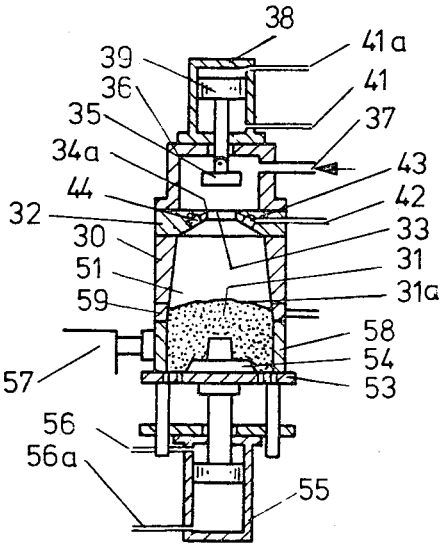
FIG. 8 depicts the same device as FIGS. 5–7 showing a subsequent stage of operation with molding sand delivered to the molding box.

A sand silo 46 for supplying a dosed amount of molding sand 31 is connected to a feed mechanism 47 by means of which the silo 46 may be moved from a molding sand deposit position into a position coinciding with the position of the vessel 30. The molding sand silo 46 may be moved in the direction of the axis of symmetry of the unit toward vessel opening 49 by a fluid drive provided as a part of the feed mechanism 47. The opening cross section of the silo 46 may be selected to be greater than the maximum cross sectional area of the vessel 30 in correspondence with the size of the casting mold to be produced. Such an arrangement is shown in FIG. 6. Likewise, the opening side 50 of the molding sand silo 46 may be adapted to the opening side of the vessel 30 so that the silo 46 may be brought to bear on the vessel 30 by means of the fluid drive 48. Furthermore, it is possible to form the maximum cross-sectional area of the silo 46 smaller than the chamber cross section 51 of the vessel 30 so that the molding sand silo may be pushed into the vessel 30. In another embodiment, the vessel 30 combined as a unit with other parts of the equipment may be moved toward the molding sand silo 46 where the aforementioned cross-sectional areas of the silo 46 may likewise be provided for use.

The form of the cross-sectional area of the vessel 30 and similarly that of the silo 46 correspond to a great extent to that of the casting mold to be produced where the volume of the vessel 30 as well as the volume of the silo 46 are determined in accordance with the filling volume of the casting mold.

In order to maintain a suction after flow through the molding sand 31, the wall of the silo 46 is made porous. Preferably, only a part of the silo 46, for example the bottom side 52, may be made porous.

A pattern device 53 including a pattern member 54 extending toward the open side 49 of the vessel 30 is arranged about the same axis of symmetry as that of the unit formed with the vessel 30. The pattern device 53 may be moved in the direction of the axis of symmetry by a fluid drive 55 connected with the pattern device 53 which is actuated over control conduits 56, 56*a* by the control system previously mentioned.

A molding box 58 held by a supporting mechanism 57 is brought into a position coinciding with the position of the vessel 30 and with the pattern device 53 in one stage of the process of the present invention. At the same time, a stripping frame 59 which operates to strip excess molding sand 31*a* from the box 58 is inserted between the box 58 and the vessel 30. In place of the stripper frame 59 utilization may also be made of the inner edge of the vessel opening 49 for the purposes of stripping the sand or, alternatively, a following sand stripper may be used.

In the operation of the embodiment according to FIGS. 5–10, the molding sand silo 46 is filled during a first stage of the process from a molding sand deposit with molding sand 31 and it is brought by means of the mechanism 47 into a position coinciding with the position of the vessel 30. Subsequently, control valve 45 (see FIG. 9) provided for operation of the suction pipe 42 is opened and at the same time molding sand silo 46 is brought into connection with the vessel 30 by means of the fluid drive 48. A vacuum is thus produced in the space between the ring conduit 43 and the side of the molding sand 31 facing the ring conduit 43 and this vacuum is maintained with a suction afterflow through mold sand 31, the sand being conveyed from the silo 46 to vessel 30 so that it is brought into a cohesive form in the vessel 30. Depending upon the design of the silo 46, the silo may be separated from the vessel 30 during or after the transfer of molding sand to the vessel 30 and it may be taken out of the range of the position of the vessel 30.

Subsequently, the molding box 58 is brought by the support mechanism 57 into a position coinciding with the vessel 30 and the pattern device 53 and at the same time the stripping frame is inserted in the position between the box 58 and the vessel 30.

By actuation of the fluid drive 55, the pattern device 53 is conducted toward the molding box 58 and the pattern device 53, the box 58 and the stripping frame 59 with the vessel 30 may be thus assembled as a unit in order to form a chamber 51 bounded by these parts.

During the further course of the operation of the apparatus, the thrust piston drive 38 is actuated and the thrust piston 39 is moved in order to move the valve member 35 connected thereto away from the valve seat 34*a* so that the valve means 34 will be opened thereby supplying pressurized fluid from within the pressure tank 36 through the orifice 33 in order to impart to the molding sand 31 an acceleration in the direction of the pattern device 53 thereby to effect suitable compression of the molding sand. The accelerated molding sand 31 impinges against the pattern device 53 and when it impacts against the pattern device a braking is effected by viture of this impingement and also by virtue of the partial impingement of the molding sand against the molding box. Before, during or after the opening of the valve means 34 by lifting of the valve member 35 from the valve seat 34*a* the control valve 45 is closed.

Figure 9:
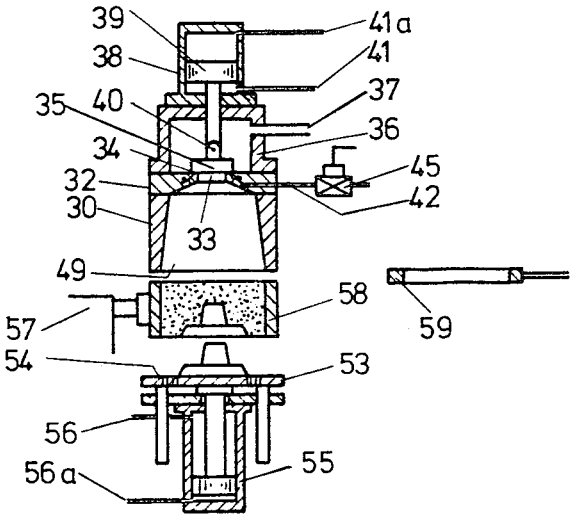
FIG. 9 is a view similar to the views of FIGS. 5–8 showing the same arrangement after formation of a finished casting mold.
Figure 10:
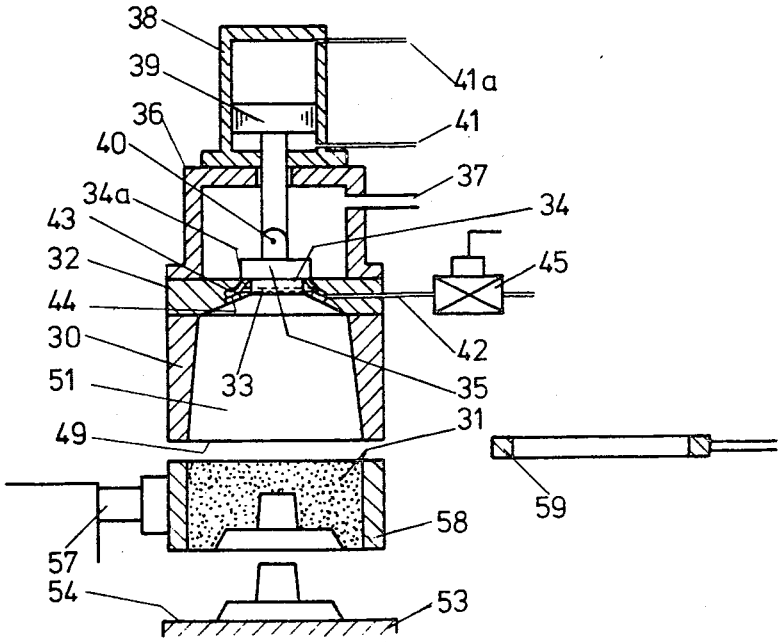
FIG. 10 is a view similar to FIG. 9 showing the same structure on a larger scale.

As best seen in FIGS. 9 and 10, after the molding sand 31 has been applied, the pattern device 53 is moved away from the box 58 by actuation of the fluid drive 55 and the casting mold is now formed in the box 58 and is fed by means of supporting mechanism 57 to another molding station. While the casting mold held within the box 58 is conveyed in this manner, the excess molding sand 31*a* is stripped therefrom by the stripping frame 59 which forms the level of the molding sand to the level of the box of the casting mold.

Together with formation of the casting mold, a dosed amount of molding sand 31 is fed to the molding silo 46 in order to permit a subsequent operation to commence.

Figure 11:
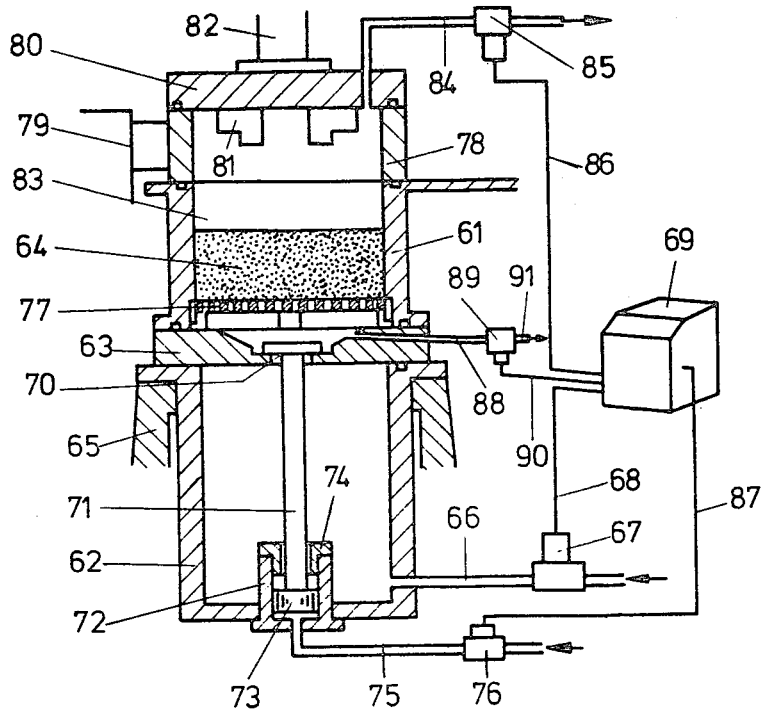
FIG. 11 is a sectional view showing a further embodiment of the invention including schematic representations of certain parts.
Figure 12:
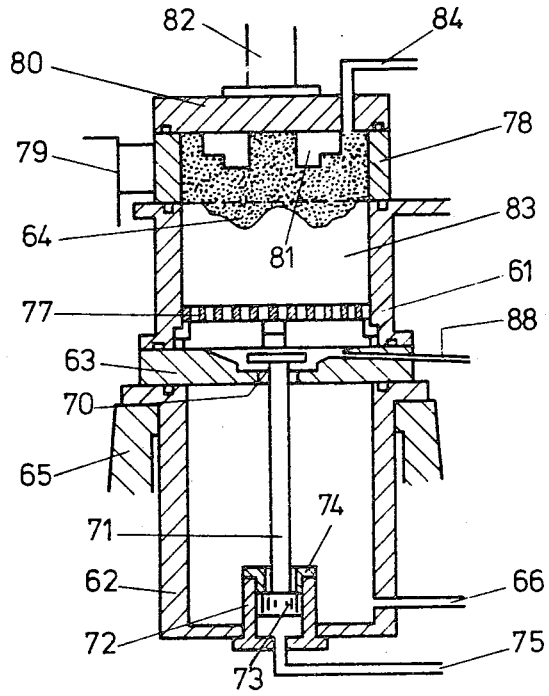
FIG. 12 is a sectional view similar to that of FIG. 11 showing the same structure during a subsequent stage of operation where the molding sand is compressed on the pattern device.

A further embodiment of the invention is schematically depicted in FIGS. 11 and 12 and is shown to include a pressure tank 62 which is connected through an intermediate plate 63 with a vessel 61 receiving therein molding sand 64. The pressure tank 62, which is inserted into a portion 65 of a molding machine, is connected through a pressurized fluid line 66 over a control valve 67 to a source of fluid pressure. Instead of a pressurized fluid device there may also be utilized other force producing means such as, for example, a mechanical device actuated by a spring element. A control line 68 extends from the control valve 67 to a central control system 69 of the molding machine.

In the intermediate plate 63 there is provided valve means which include a valve member 70 connected through a valve stem 71 to a piston 73 inserted in a cylinder 72 and actuated by a pressurized fluid medium. The cylinder 72 is detachably connected with a wall of the pressure tank 62 and is provided with a flange 74 which operates to limit the stroke of the piston 73. The cylinder 72 is connected through a pressure conduit 75 and a control valve 76 with a source of fluid pressure.

It should be understood that in the operation of the present invention, the fluid pressure medium utilized may be either a liquid or a gaseous medium.

Furthermore, it will be apparent that the valve 70 may also be designed to be actuated by mechanical or electrical means.

A control line 87 leads from the control valve 76 to the central control system 69. In the plate 63 there is arranged a conduit 88 leading within the range of the valve means formed through the plate 63 into the space of the vessel 61 with the line 88 being connected through a valve 89 over a control conduit 90 to the central control system 69. By means of the conduit 88 and the valve 89 it is possible to equalize the pressure, if needed, in the molding cycle between the space formed by the molding sand 64 and the intermediate plate 63 and the surrounding atmosphere. However, the valve 89 may also be connected through another conduit 91 to a suction device, which may, for example, be a fan or blower, so that the space formed between the molding sand 64 in the vessel 61 and the intermediate plate 63 may be evacuated before the mold forming operation. Thus, the molding batch may thus be fixed in its position thereby resulting in that the arrangement may be utilized in any angular position.

The vessel 61 is opened on the side thereof remote from the intermediate plate 63. The inner surfaces of the vessel 61 generally extend parallel to this side but they may also be divergent, widening the vessel space or forming a special geometric configuration. The connection of the intermediate plate 63 with the vessel 61 and the pressure tank 62 is fluid-tight and both detachable and non-detachable connecting means may be utilized for this connection.

Within the range of the valve member 70 there is provided in the vessel 61 a perforated support plate 77 which is designed essentially as a supporting grate. The support plate 77 may be fixed or movable with a limited degree of movement in the direction of the open side of the vessel 61.

Adjoining the vessel 61 there is movably mounted a molding box 78 which is connected for movement to a control mechanism 79 operating under the influence of the molding machine. In place of the box 78, which is preferably utilized for the production of box-less sand casting molds, there may also be provided a molding box adapted to the molding process.

On the box 78 there may be applied a pattern device 80 equipped with patterns 81 which is additionally provided with conventional molding devices. Pattern device 80 which is movable in all directions may be, for example, connected to a piston rod 82 of a control mechanism which is part of the molding machine.

The connection of the box 78 with the pattern device 80, on the one hand and with the vessel 61 on the other hand, is generally fluid tight.

Pattern device 80, box 78 and vessel 61 assembled together form a chamber 83 which in part is provided to receive molding sand 64. The chamber 83 is connected over a suction conduit 84 and a vacuum control valve 85 to a suction device. Vacuum control valve 85 is connected through a control conduit 86 to the central control system 69. The volumetric cross-section of the box 78 parallel to the pattern device 80 is substantially equal to the volumetric cross-section of vessel 61 extending in a parallel plane.

The method of operation of the embodiment of FIGS. 11 and 12 of the present invention consists substantially in that a dosed amount of molding sand 64 is first introduced into the vessel 61 and lowered on to the support 77. The central control system 69 then emits a pulse to the control mechanism 79 after which the box 78 is brought during the cycle of operation of the molding machine into a position coinciding with the vessel 61. The pattern device 80 is moved to a position coinciding with the position of the box 78 and chamber 83 which is now sealed in a fluid tight arrangement is placed under a vacuum by the opening of the valve 85.

In a controlled timed sequence, control valve 76 and control valve 67 are actuated so that pressure fluid accumulated in the pressure tank 62 will issue through the valve 70 thereby exerting a force on the side of the molding sand directed toward the valve 70. The molding sand is thus accelerated in a manner suitable to effect compression thereof after which the molding sand thus accelerated in the direction of the pattern device will impinge against the pattern device and by striking the pattern device it will experience a braking force. Thus, the molding sand will be compressed about the pattern device to form half of a complete casting mold. During or following this operation, the valves 67, 76, 85 and 89 are actuated in a time-controlled sequence so that appropriate functions are effected for lifting the pattern device from the compressed casting mold and for lifting the casting mold from the vessel 61 whereby the arrangement may be made ready for a subsequent molding operation.

From the foregoing it will be seen that the present invention provides several distinct advantages which consist particularly in that a substantially improved compression of the molding sand is effected so that a suitable cohesive form may be achieved with the quality of the molded pieces being thus produced undergoing improvement. A further advantage results from the fact that the parts are arranged so that forces required for conveying and moving the various parts may be relatively low and accordingly energy consumption is reduced.

The arrangement may be utilized in any angular position and the process may be applied both for the production of box-less sand casting molds and for those formed in molding boxes.

While specific embodiments of the invention have been shown and described in detail to illustrate the application of the inventive principles, it will be understood that the invention may be embodied otherwise without departing from such principles.

What is claimed is:

1. Apparatus for producing foundry molds comprising vessel means for receiving therein a dosed amount of mold forming material, vacuum means for applying to said vessel means a suction effect to render mold forming material contained within said vessel means into a more cohesive mass, pressure means located adjacent said vessel means for applying a pressurized force to said mold forming material to propel said material out of said vessel means, valve means operatively interposed between said pressure means and said vessel means to control application of said pressurized force to said mold forming material, and pattern means including molding box means for receiving said mold forming material from said vessel means to form a mold therefrom, said valve means operating to block fluid flow between said pressure means and said vessel means while said vacuum means is applying suction to mold forming material contained within said vessel means, said valve means operating to open to permit fluid flow from said pressure means into said vessel means after said vacuum means have ceased applying suction within said vessel means and after said vessel means and said molding box means have been placed in operative relationship to enable transference of said mold forming material from said vessel means into said molding box means, with opening of said valve means operating to cause said pressure means to apply a pressurized force to said mold forming material to propel said mold forming material against said pattern means and to compress said mold forming material about said pattern means in order to form said foundry molds therefrom.

2. Apparatus for producing foundry molds comprising a vessel for receiving therein mold forming material, said vessel including an open side, a pressure tank adjoining said vessel on the side thereof opposite said open side, a silo for depositing mold forming material into said vessel, said silo including an outlet opening adapted to be placed in operative relationship with the open side of said vessel in order to enable said mold forming material to be delivered into said vessel from said silo when said silo and said vessel are moved into appropriate relative positions adjoining each other, valve means for selectively placing said pressure tank and said vessel in fluid flow communication with each other, molding box means including a pattern device adapted to be operatively joined with said vessel to form a generally enclosed chamber therebetween and pressure means for applying a pressurized fluid within said pressure tank, said valve means operating to open flow communication between said vessel and said pressure tank to admit said pressurized fluid into said vessel when said molding box means and said vessel are operatively joined in order thereby to accelerate said mold forming material through said enclosed chamber by application of said pressurized fluid thereto and to cause said mold forming material to strike said pattern device and to be compressed about said pattern device within said molding box means.

3. Apparatus according to claim 2 wherein said vessel comprises an inner surface which diverges toward said molding box means.

4. Apparatus according to claim 2 wherein said vessel comprises an inner surface defined by sides extending toward said molding box means, said sides being substantially parallel to each other.

5. Apparatus according to claim 2 wherein said molding box means comprises a volumetric cross-section extending parallel to said pattern device, said volumetric cross-section of said molding box means being substantially equal to a volumetric cross-section of said vessel extending in a parallel plane.

6. Apparatus according to claim 2 wherein said molding box means and said pattern device are connected with said vessel in a fluid tight relationship.

7. Apparatus according to claim 2 wherein said pattern device is movable in all directions.

8. Apparatus according to claim 2 wherein said pressure tank includes piston means connected with said valve means, said piston means in said pressure tank being adapted to actuate said valve means.

9. Apparatus according to claim 2 further including a perforated support plate arranged within said vessel adjacent said valve means defining within said vessel a space between said perforated plate and said valve means.

10. Apparatus according to claim 9 wherein said perforated support plate is arranged for limited movement in the direction of said pattern device.

11. Apparatus according to claim 2 wherein said vessel comprises an inner surface having a cross-sectional area which is undiminished taken in the direction toward said molding box means.

12. Apparatus for producing foundry molds comprising a vessel for receiving therein mold forming material, said vessel including an open side, a pressure tank adjoining said vessel on the side thereof opposite said open side, valve means for selectively placing said pressure tank and said vessel in fluid flow communication with each other, molding box means including a pattern device adapted to be operatively joined with said vessel to form a generally enclosed chamber therebetween, pressure means for applying a pressurized fluid within said pressure tank, said valve means operating to open flow communication between said vessel and said pressure tank to admit said pressurized fluid into said vessel when said molding box means and said vessel are operatively joined in order thereby to accelerate said mold forming material through said enclosed chamber by application of said pressurized fluid thereto and to cause said mold forming material to strike said pattern device and to be compressed about said pattern device within said molding box means, an intermediate plate extending between said pressure tank and said vessel, said intermediate plate having said valve means formed therethrough, said vessel, said pressure tank and said intermediate plate being assembled as a unit, with said unit being formed with an axis of symmetry extending through said vessel, said intermediate plate and said pressure tank, and means enabling said unit to be swiveled about an axis extending perpendicularly to said common axis of symmetry of said unit.

13. Apparatus according to claim 12 further including a silo for delivering mold forming material into said vessel, said pressure tank and said silo being movable in the direction of said common axis of symmetry.

14. Apparatus according to claim 13 wherein said silo is situated beneath said vessel.

15. Apparatus for producing foundry molds comprising a vessel for receiving therein mold forming material, said vessel including an open side, a pressure tank adjoining said vessel on the side thereof opposite said open side, valve means for selectively placing said pressure tank and said vessel in fluid flow communication with each other, molding box means including a pattern device adapted to be operatively joined with said vessel to form a generally enclosed chamber therebetween and pressure means for applying a pressurized fluid within said pressure tank, said valve means operating to open flow communication between said vessel and said pressure tank to admit said pressurized fluid into said vessel when said molding box means and said vessel are operatively joined in order thereby to accelerate said mold forming material through said enclosed chamber by application of said pressurized fluid thereto and to cause said mold forming material to strike said pattern device and to be compressed about said pattern device within said molding box means, the chamber formed between said molding box means and said vessel being connected to a vacuum unit forming material through said enclosed chamber by application of said pressurized fluid thereto and to cause said mold forming material to strike said pattern device and to be compressed about said pattern device within said molding box means.

16. Apparatus for producing foundry molds comprising a vessel for receiving therein mold forming material, said vessel including an open side, vacuum means for applying suction to said vessel in order to compact and render into a more cohesive state mold forming material contained therein, a pressure tank adjoining said vessel on the side thereof opposite said open side, valve means for selectively placing said pressure tank and said vessel in fluid flow communication with each other, molding box means including a pattern device adapted to be operatively joined with said vessel to form a generally enclosed chamber therebetween and pressure means for applying a pressurized fluid within said pressure tank, said valve means operating to open flow communication between said vessel and said pressure tank to admit said pressurized fluid into said vessel when said molding box means and said vessel are operatively joined in order thereby to accelerate said mold forming material through said enclosed chamber by application of said pressurized fluid thereto and to cause said mold forming material to strike said pattern device and to be compressed about said pattern device within said molding box means.

17. Apparatus according to claim 16 wherein said vacuum means are connected to be placed in communication with the interior of said vessel at a location adjacent said valve means.

* * * * *